United States Patent [19]

Lemaster

[11] Patent Number: 4,524,689

[45] Date of Patent: Jun. 25, 1985

[54] DEHYDRATION APPARATUS FOR PRINTING PRESS INKING SYSTEM

[76] Inventor: Milton R. Lemaster, 16528 Voss Rd., Dallas, Tex. 75252

[21] Appl. No.: 613,743

[22] Filed: May 22, 1984

Related U.S. Application Data

[63] Continuation of Ser. No. 416,903, Sep. 13, 1982, abandoned.

[51] Int. Cl.[3] ..... B41L 23/20; B41L 17/24

[52] U.S. Cl. ..... 101/141; 34/122; 101/349; 101/426

[58] Field of Search ..... 34/114, 122; 101/141, 101/142

[56] References Cited

U.S. PATENT DOCUMENTS

| | | | |
|---|---|---|---|
| 1,568,382 | 1/1926 | Otten | 101/349 |
| 1,993,440 | 3/1935 | Hartman | 101/416 |
| 2,041,238 | 5/1936 | Fickes | 34/18 |
| 2,268,594 | 1/1942 | Huber | 101/426 |
| 2,676,536 | 4/1954 | Ste-Marie | 101/141 |
| 2,804,693 | 9/1957 | Brodie | 34/18 |
| 3,008,242 | 11/1961 | Sites et al. | 34/1 |
| 3,110,575 | 11/1963 | Justus | 34/114 |
| 3,363,665 | 1/1968 | Daane | 34/122 |
| 3,434,224 | 3/1969 | Blomgren | 34/114 |
| 3,469,526 | 9/1969 | Gallagher | 101/142 |
| 3,702,503 | 11/1972 | Nichols | 34/114 |
| 4,008,661 | 2/1977 | Mathis | 101/181 |

*Primary Examiner*—Clyde I. Coughenour

*Attorney, Agent, or Firm*—Hubbard, Thurman, Turner & Tucker

[57] ABSTRACT

A system for dehydrating the inking roller system of a lithographic rotary printing press includes providing a flow stream of pressure air or other dry gas across the inking roller system to evaporate water entrained with the ink and which has migrated from the plate cylinder through the inking roller system as a result of application of water to the plate cylinder. An elongated distribution manifold is mounted on the press in proximity to the inking roller distribution system and preferably in proximity to one or more of the vibratory rollers in direct contact with the inking rollers engaged with the plate cylinder.

3 Claims, 3 Drawing Figures

FIG. 1
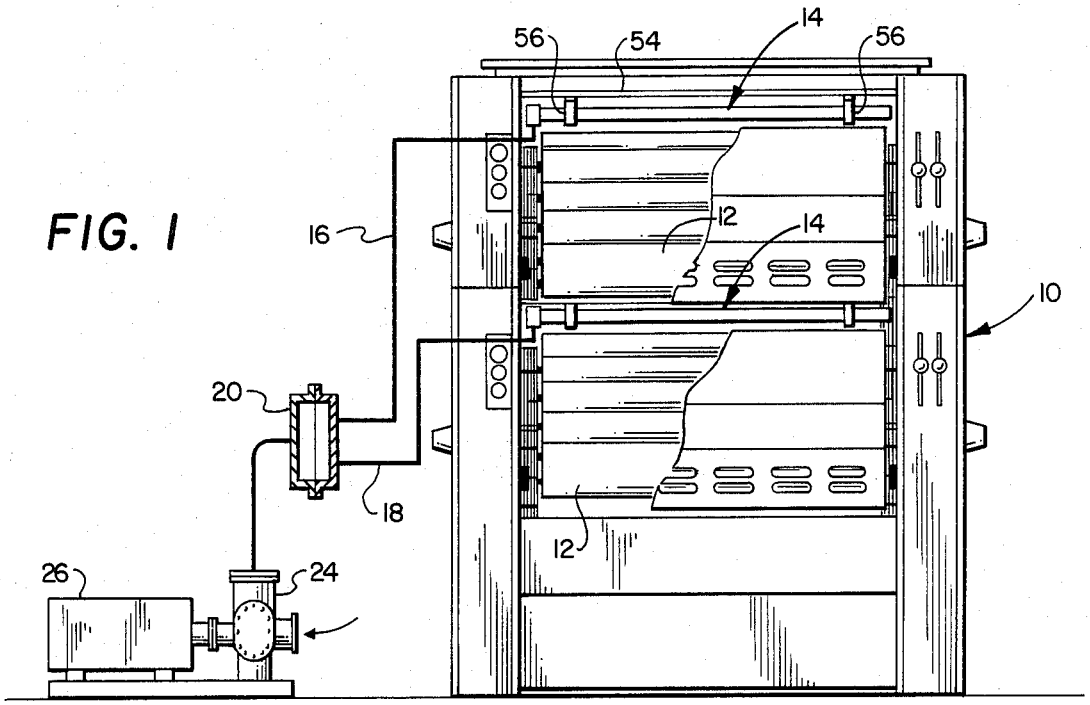
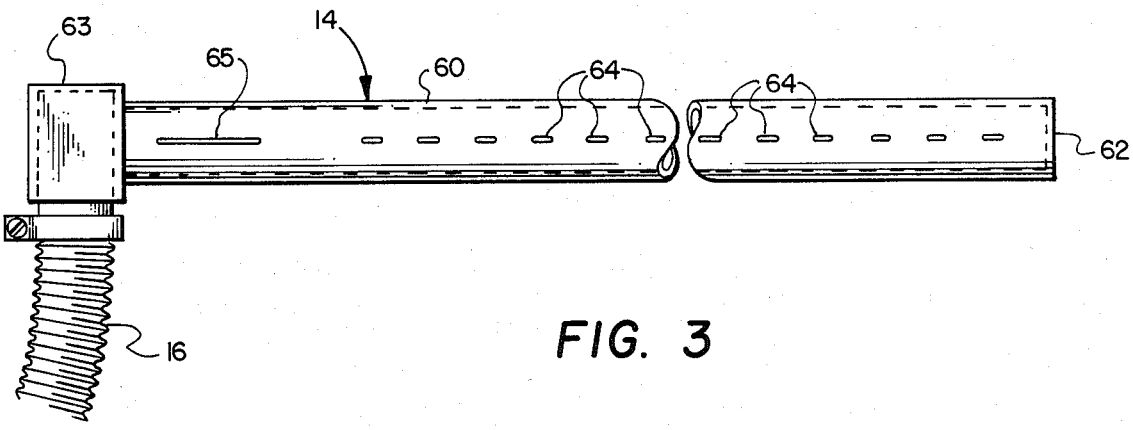
FIG. 3

DEHYDRATION APPARATUS FOR PRINTING PRESS INKING SYSTEM

This application is a continuation of application Ser. No. 416,903, filed Sept. 13, 1982 now abandoned.

BACKGROUND OF THE INVENTION

Field of the Invention

The present invention pertains to an apparatus and method of eliminating water in the inking system of a printing press utilizing a curtain of drying air which is blown over the inking rollers.

Background

Planographic printing processes including lithographic printing are widely used for producing a myriad of printed materials and in particular in multicolor printing. In the basic process of lithographic printing water is applied to the so called plate cylinder in order to prevent the deposition of ink on the printing plate in the areas where no image is wanted. Conventional lithographic printing presses utilize a relatively complex system of inking rollers to distribute the ink evenly onto the plate cylinder. The plate cylinder must, of course, also be exposed to a system for depositing water on the printing plate which, normally, comprises a second set of rollers engaged with the plate cylinder at a point on the circumference of the cylinder generally opposed to the inking rollers. However, inevitably, the inking rollers in contact with the plate pick up some of the water applied to the plate and distribute the water through the inking roller system.

The presence of water in the inking roller system of lithographic printing presses affects the images being printed including causing what is known in the art as "ghosting", and also affecting the coloration of the ink in multicolor printing. The cause of the so called ghost imaging in lithographic printing and the subtle discoloration caused by the presence of water in various colored inks has been little understood and has been dealt with only by efforts to change the ink composition or to reduce the amount of water applied to the plate cylinder. However, by decreasing the amount of water applied to the plate cylinder, the repelling of ink from the non-image areas of the plate is reduced and images appear where they are unwanted.

With the discovery of the present invention substantial improvements have been realized in the quality of printed material obtainable with single and multicolor lithographic printing process.

SUMMARY OF THE INVENTION

The present invention provides an apparatus and method for removing water as a contaminant in the inking system of a lithographic printing press or the like.

In accordance with one aspect of the present invention there is provided apparatus for providing a curtain or flow stream of pressure air which is distributed over at least a portion of the inking roller system for a planographic or lithographic type printing press to partially dehydrate the ink being distributed by the inking roller system to remove water as a contaminant in the ink.

The apparatus of the present invention is preferably characterized by an elongated air distribution manifold which is placed generally adjacent to the ink distribution rollers of the inking system of a lithographic press, which manifold has a plurality of nozzles which are directed at the inking rollers to provide for blowing a curtain of relatively high velocity air or other dry gas over the inking roller system to evaporate water which has migrated into the ink being distributed. The air distribution manifold may be adjustably positioned adjacent to the inking roller system of each plate cylinder in a multicolor press and may be supplied with pressure air from a source such as a low pressure blower through a supply manifold. The operation of the dewatering system is preferably controlled in conjunction with operation of the inking system to prevent unwanted drying of the rollers when the press is momentarily stopped or otherwise not applying ink to the printing plate through the inking rollers.

In accordance with another aspect of the present invention there is provided a method for preventing the contamination of the inking roller system of a lithographic printing press with water from the moistening roller system by applying a flow stream of pressure air or other gas suitable for evaporating water from the ink being distributed. It has been discovered in accordance with the present invention that by applying a curtain of low pressure air at relatively high velocity through the inking roller system that poor quality printing associated with contamination of the ink with water is eliminated.

Those skilled in the art will appreciate the above-noted advantages of the present invention as well as other superior aspects thereof upon reading the detailed description which follows in conjunction with the drawings.

BRIEF DESCRIPTION OF THE DRAWINGS

FIG. 1 is a schematic illustration of the dewatering system of the present invention in use on a two color lithographic printing press;

FIG. 3 is a longitudinal plan view of one of the air distribution manifolds showing the arrangement of the air outlet orifices.

DESCRIPTION OF THE PREFERRED EMBODIMENTS

Figure 2:
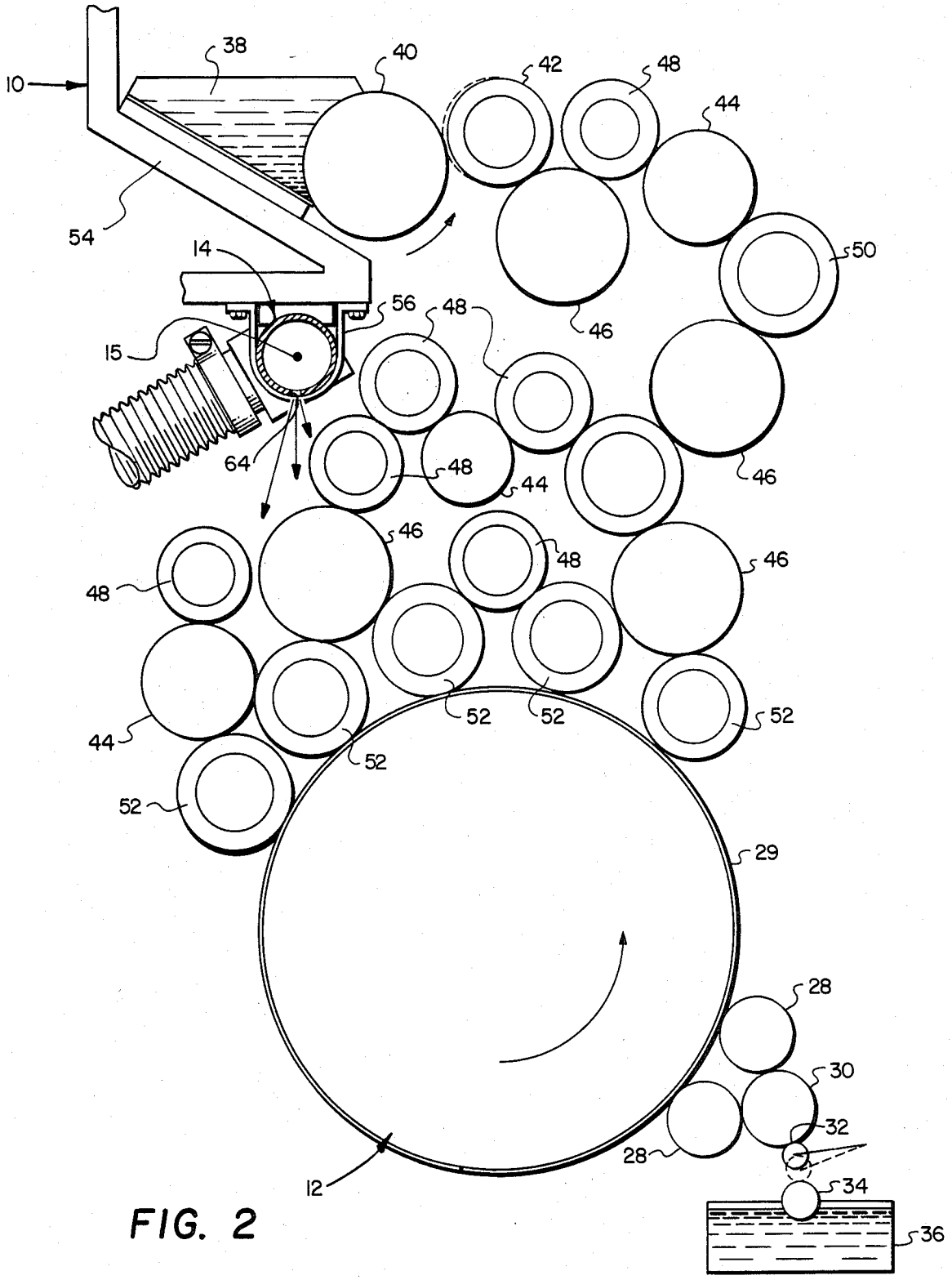
FIG. 2 is a schematic side elevation of the inking roller system of one stage of a lithographic printing press showing the general location of the air distribution manifold.

In the description which follows like parts are marked throughout the specification and drawings with the same reference numerals, respectively. Some of the drawing figures are in schematic form in order to illustrate the feature of the invention with clarity and in the interest of conciseness.

Referring to FIG. 1 there is illustrated a schematic diagram of an air curtain type dewatering system in accordance with the present invention. The system of the present invention is adapted to be used on lithographic printing presses such as two stage or two color press generally designated by the numeral 10. The press 10 is adapted to have two printing stages of the offset type, each including a plate cylinder, a blanket cylinder and an impression cylinder. Only the plate cylinders is referenced in the drawing figure and indicated by the numeral 12; however, those skilled in the art will be able to readily understand the general arrangement of the system of the present invention upon reading the further description herein in conjunction with FIG. 2, in particular.

Each of the plate cylinders is provided with an inking roller system and a moistening roller system of the type to be described herein in conjunction with FIG. 2. In accordance with the present invention it has been discovered that the problems identified with contamination of the inking roller system with water from the plate cylinder can be effectively eliminated by providing at least one elongated pressure air distribution manifold, such as the manifolds designated by the numeral 14, for each of the printing stages of the press 10. The manifolds 14 are preferably arranged in relation to the inking roller system of each printing stage to direct a stream of pressure air toward the inking distribution rollers, preferably on the latter stages of the set of inking rollers in contact with the plate cylinder.

Referring further to FIG. 1, the air distribution manifolds 14 are adapted to be supplied with pressure air through respective conduits 16 and 18 which are in communication with a supply manifold generally designated by the numeral 20. The supply manifold 20 is connected to a source of pressure air such as a low pressure compressor or blower 24 driven by a suitable electric motor or other prime mover 26. The blower 24 may be selected from one of several types adapted for relatively low pressure high volume service such as a centrifugal or lobe type blower. A typical example of a blower suitable for a four color lithographic press having 40 inch sheet width capability in a 200 Series model manufactured by Lamson Corporation, Syracuse, N.Y. delivering approximately 200 cfm at 0.80 psig discharge pressure.

Referring now to FIG. 2 there is illustrated in somewhat schematic form the general arrangement of the inking roller system for applying ink to one of the plate cylinders 12 of a press such as the press 10 referenced in FIG. 1. The blanket cylinder and impression cylinder for the press 10 are not illustrated in FIG. 2 as this portion of the press forms no part of the present invention per se. Moreover, the inking system distribution roller arrangement illustrated in FIG. 2 is exemplary in the sense that it will be understood that the pressure air distribution system and method in accordance with the present invention may be used in conjunction with the inking roller system of various lithographic and other planographic presses. The schematic diagram of FIG. 2 includes an arrangement for the plate cylinder 12 of a moistening roller system including rollers 28 which are in direct engagement with a printing plate surface 29 on the plate cylinder and are supplied with water from a common distribution roller 30 which is engaged with an oscillating feed roller 32 which oscillates between the roller 30 and a supply roller 34 at least partially immersed in a water reservoir 36.

The inking roller system includes a source of ink such as a fountain 38, a fountain roller 40, an oscillating feed roller 42, a series of vibratory rollers 44 and 46 and a system of composition rollers 48, 50 and 52, all of which form a feeding and distribution system for ink to be applied to the surface 29 on the plate cylinder 12.

It has been discovered in accordance with the present invention that in conventional lithographic rotary printing presses the application of water to the surface of the plate cylinder by the moistening roller system is not controlled precisely enough to prevent some accumulation of water on the ink distribution rollers 52. This pickup of water on the rollers 52 results in additional migration of the water through the inking roller system. The result of this accumulation and migration of water is an uneven distribution of ink, a development of secondary or "ghost" images on the printed material, and dilution of the ink to the extent that the color may be affected. This discovery of a longstanding problem associated with lithographic rotary presses has resulted in the provision of means for dewatering the inking roller system including the air distribution manifold 14.

As illustrated in FIG. 2 the manifold 14 is supported on a frame portion 54 for the press 10, for example, by means of suitable spaced apart clamps 56, one shown in FIG. 2. The clamps 56 may be selectively tightened to secure the manifold 14 in a predetermined rotative position with respect to its longitudinal central axis 15 to direct the stream of pressure air in the desired direction. Further in accordance with the present invention it has been determined that by placing the distribution manifold in proximity to the inking roller system and preferably near the distribution rollers last in contact with the plate cylinder, with respect to the plate cylinder direction of rotation, that the abovementioned problems resulting from migration of water into the inking roller distribution system have been eliminated.

Referring now to FIG. 3 there is illustrated a preferred form of the air distribution manifold 14 which is characterized as an elongated cylindrical tubular conduit 60 having a closed end 62 and a fitting 63 formed at the opposite end for connecting the manifold to the supply conduit 16. In installations for retrofitting existing presses the supply conduit 16 is preferably a flexible wire reinforced plastic type hose or the like which facilitates installation and minimizes installation time and plumbing work. Moreover, the retrofitting of existing presses also results in the preferred arrangement wherein the distribution manifold tube 60 is supplied with pressure air from one end as illustrated.

It is, of course, desirable to provide a relatively even distribution of airflow over the entire length of the inking roller system and in this regard it has been determined that a series of spaced apart somewhat elongated orifices 64 should be provided in a pattern as indicated generally by the arrangement illustrated in FIG. 3. However, it has also been determined that, in order to provide even air flow distribution from a manifold wherein the air is supplied to the manifold at one end thereof, one of the orifices should be relatively longer or of greater cross-sectional flow area. For example, the orifice 65 directly adjacent to the inlet fitting 63 is approximately six times the cross-sectional flow area of the remaining orifices 64. In a typical example for use in conjunction with a 40 inch or 60 inch press the configuration of the tubular conduit 60 is a thin walled steel tube of nominal 1.125 inches diameter having a plurality of orifices 64 of 0.250 inches length by 0.062 inches width and spaced apart at 0.50 inch intervals along the length of the conduit. The inlet pressure equalization orifice 65 is approximately 1.50 inches length by 0.062 width.

The installation and operation of the dewatering system described and illustrated in conjunction with the drawing figures is believed to be readily understandable by those skilled in the art. Air is preferably supplied to the distribution manifolds 14 at all times during operation or rotation of the plate cylinder and the inking roller system. In this regard the motor 26 is controlled to drive the blower 24 during press operation or, alternatively, the flow of air through the supply conduit 16 and 18 may be redirected during times when the press is shut down. Other forms of control of air flow in relation to press operation will also be apparent to those skilled in the art of fluid power distribution systems.

Although a preferred embodiment of the invention has been described herein those skilled in the art will also appreciate that various substitutions and modifications may be made to the specific arrangement described without departing from the scope and spirit of the invention as recited in the appended claims.

What I claim is:

1. Apparatus for mounting on a preinstalled lithographic printing press for reducing the water dilution of ink on the inking rollers of said press wherein said water dilution is caused by the mixing of water used for moistening the printing surface of said press with ink on said inking rollers, said press including a frame and a rotating plate cylinder mounted on said frame, and said inking system including a plurality of inking rollers engaged with said plate cylinder and arranged in series relationship to each other around a portion of the circumferential surface of said plate cylinder in the direction of rotation of said plate cylinder, said apparatus comprising:

an elongated cylindrical tubular conduit having an opening at one end for receiving a supply of low pressure air, said conduit being closed at the opposite end;

a plurality of elongated slot shaped orifices spaced apart along said conduit and aligned with each other in such a way as to direct a uniform curtainlike flowstream of pressure air toward said inking rollers;

one of said orifices being adjacent said one end of said conduit and being longer than the other of said orifices to provide for equal distribution of flow of air from said conduit with respect to the longitudinal axis thereof and toward said inking rollers;

spaced apart clamp means for supporting said conduit on said press, said clamp means being operable to support said conduit in a preselected rotative position of said conduit so that said orifices are operable to direct a uniform curtainlike flowstream of pressure air toward the last of said inking rollers in contact with said plate cylinder in the direction of rotation of said plate cylinder;

a flexible hose connected at one end to said one end of said conduit; and pressure air blower means connected to the other end of said hose for supplying pressure air to said conduit to produce said flowstream of pressure air to dehydrate ink on said last inking roller.

2. Apparatus for reducing the water dilution of ink on the inking rollers of a lithographic printing press wherein said water dilution is caused by the mixing of water used for moistening the printing surface of said press with ink on said inking rollers, said press including a rotating plate cylinder, and said inking system including a plurality of inking rollers engaged with said plate cylinder and arranged in series relationship to each other around a portion of the circumferential surface of said plate cylinder in the direction of rotation of said plate cylinder, said apparatus comprising:

an elongated tubular conduit having an opening at one end for receiving a supply of low pressure air, said conduit being closed at the opposite end;

a plurality of orifices spaced apart along said conduit and aligned with each other in such a way as to direct a uniform curtainlike flowstream of pressure air toward said inking rollers;

spaced apart clamp means for supporting said conduit on said press, said clamp means being operable to support said conduit in a preselected rotative position of said conduit so that said orifices are operable to direct a uniform curtainlike flowstream of pressure air toward the last of said inking rollers in contact with said plate cylinder in the direction of rotation of said plate cylinder;

said orifices are spaced apart along said conduit and are each of a slot like configuration extending longitudinally relative to the longitudinal axis of said conduit, and an orifice adjacent said one end of said conduit is longer than the other of said orifices to provide for equal distribution of flow of air from conduit along the longitudinal axis thereof and toward said last roller;

a flexible hose connected at one end to said one end of said conduit; and pressure air blower means connected to the other end of said hose for supplying pressure air to said conduit to produce said flowstream of pressure air to dehydrate ink on said last roller.

3. Apparatus for mounting on a lithographic printing press for reducing the water dilution of ink on the inking rollers of said press wherein said water dilution is caused by the mixing of water used for moistening the printing surface of said press with ink on said inking rollers, said press including a frame and a rotating plate cylinder mounted on said frame, and said inking system including a plurality of inking rollers engaged with said plate cylinder and arranged in series relationship to each other around a portion of the circumferential surface of said plate cylinder in the direction of rotation of said plate cylinder, said apparatus comprising:

an elongated conduit having an opening at one end for receiving a supply of low pressure air, said conduit being closed at the opposite end;

a plurality of elongated slot shaped orifices spaced apart along said conduit and aligned with each other in such a way as to direct a uniform curtainlike flowstream of pressure air toward said inking rollers;

one of said orifices being adjacent said one end of said conduit and being longer than the other of said orifices to provide for equal distribution of flow of air from said conduit with respect to the longitudinal axis thereof and toward said inking rollers;

support means for supporting said conduit on said press, said support means being operable to support said conduit in a preselected position of said conduit so that said orifices are operable to direct a uniform curtainlike flowstream of pressure air toward the last of said inking rollers in contact with said plate cylinder in the direction of rotation of said plate cylinder;

pressure air conducting means connected to said one end of said conduit; and pressure air blower means connected to said pressure air conducting means for supplying pressure air to said conduit to produce said flowstream of pressure air to dehydrate ink on said last inking roller.

* * * * *